US005761882A

United States Patent [19]

Gambetti

[11] Patent Number: 5,761,882

[45] Date of Patent: Jun. 9, 1998

[54] METHOD AND APPARATUS FOR INSERTING FLAT PARTITION ELEMENTS BETWEEN FLANKED ARTICLES

[75] Inventor: Mario Gambetti, Crevalcore, Italy

[73] Assignee: Baumer S.R.L., Castelfranco Emilia, Italy

[21] Appl. No.: 581,563

[22] PCT Filed: May 16, 1995

[86] PCT No.: PCT/IB95/00365

§ 371 Date: Jan. 16, 1996

§ 102(e) Date: Jan. 16, 1996

[87] PCT Pub. No.: WO95/31376

PCT Pub. Date: Nov. 23, 1995

[30] Foreign Application Priority Data

May 16, 1994 [IT] Italy ..... BO94A0216

[51] Int. Cl.[6] ..... B65B 35/54

[52] U.S. Cl. ..... 53/445; 53/157; 53/238; 53/448; 53/474

[58] Field of Search ..... 53/48.1, 48.6, 53/48.7, 48.8, 155, 156, 157, 238, 445, 448, 474

[56] References Cited

U.S. PATENT DOCUMENTS

| | | | |
|---|---|---|---|
| 2,615,289 | 10/1952 | Hickin | 53/445 |
| 2,968,898 | 1/1961 | Hickin | 53/157 X |
| 3,032,942 | 5/1962 | Gentry | 53/157 X |
| 3,190,048 | 6/1965 | Ganz | 53/445 |
| 3,473,295 | 10/1969 | Nigrelli et al. | 53/157 X |
| 3,651,614 | 3/1972 | Corderoy | 53/157 X |
| 3,680,278 | 8/1972 | Pearson | 53/445 |
| 3,694,994 | 10/1972 | Corderoy | 53/157 X |
| 3,719,018 | 3/1973 | Focke et al. | 53/157 X |
| 3,760,557 | 9/1973 | McIntyre | 53/157 X |
| 3,872,647 | 3/1975 | Langen et al. | 53/157 |
| 4,154,331 | 5/1979 | Graham | 53/157 X |
| 4,793,117 | 12/1988 | Raudat et al. . | |
| 4,962,625 | 10/1990 | Johnson et al. | 53/157 |
| 5,485,713 | 1/1996 | Moncrief | 53/157 X |
| 5,540,036 | 7/1996 | Scroggins et al. | 53/157 X |

FOREIGN PATENT DOCUMENTS 439 944 6/1972 Australia .

*Primary Examiner*—Daniel Moon
*Attorney, Agent, or Firm*—Herbert Dubno

[57] ABSTRACT

Partition elements are inserted between articles of a group to be packaged and can extend in the longitudinal and/or transverse direction, by inserting the partitions from the bottom upwardly between longitudinal or transverse ranks of the articles by progressively spacing the ranks apart and bringing them together as the articles are transported along a transport path.

13 Claims, 7 Drawing Sheets

Fig. 4
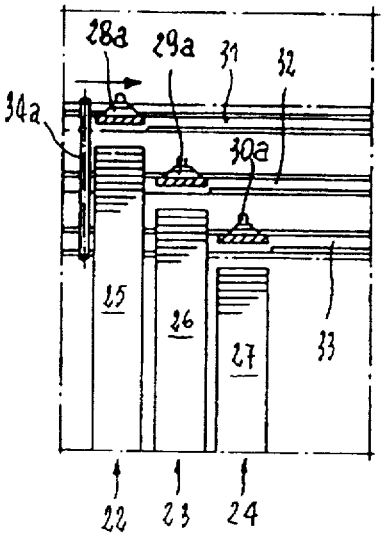
Fig. 4A
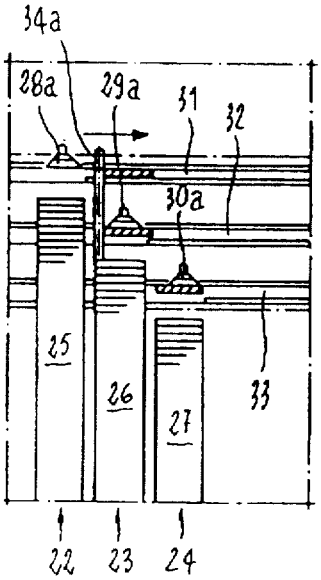
Fig. 4B
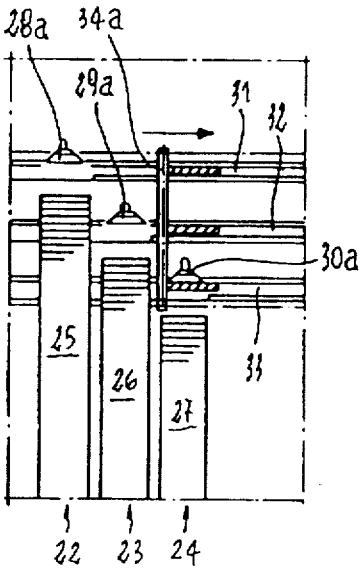
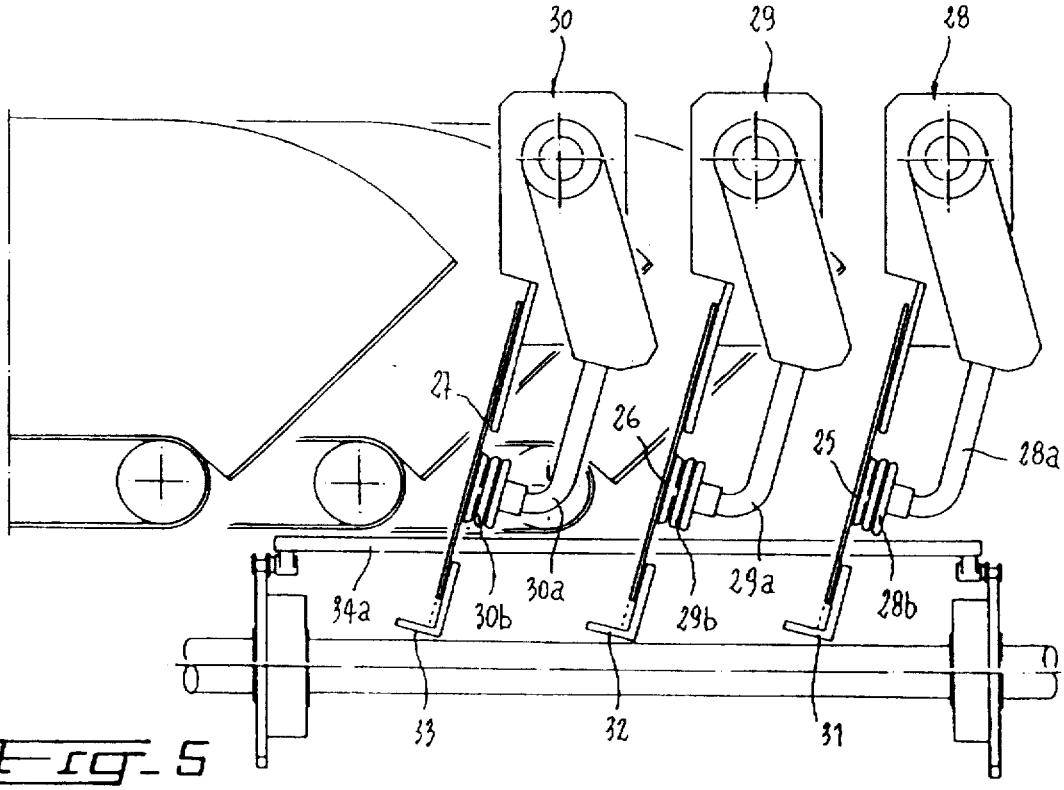
Fig. 5

METHOD AND APPARATUS FOR INSERTING FLAT PARTITION ELEMENTS BETWEEN FLANKED ARTICLES

CROSS REFERENCE TO RELATED APPLICATIONS

This application is a national phase of PCT/IB95/00365 filed 16 May 1995 and based, in turn on Italian national application BO94 A 000216 of 16 May 1994 under the International Convention.

TECHNICAL FIELD

The present invention relates to a method of and an apparatus for automatically fitting longitudinal and/or transverse flat partition elements between arrays of articles that are continuously advanced, particularly in a packaging line of articles such as cans or bottles.

BACKGROUND ART

In the packaging field and, in particular, for the packaging of breakable articles, such as glass bottles, it is often required to insert longitudinal and/or transverse flat partition elements between the articles of a package to establish a plurality of cells each of which can contain a single article, so as to avoid contact and collision between the articles, keeping them safe, for instance, during the transport of the package.

Presently, several methods and apparatuses are know for the automatic insertion of said partition elements.

For example, the patent IT-927.943 discloses that the longitudinal and/or transverse flat partition elements can be introduced consecutively between the articles of a predefined group, and that the so obtained assembly of articles and partition elements can be subsequently packaged and bound in cardboard.

To make the insertion of the longitudinal and transverse partition elements easier, the articles of the group to be packed are placed in longitudinal and transverse ranks, the longitudinal ranks are temporarily spaced apart transversely and the transverse ranks are temporarily spaced apart longitudinally, so that the partition elements can slide from above downwards, preferably by gravity, between the spaced apart ranks.

The apparatus provided to implement the above mentioned method is essentially comprised of: a conveyor provided with thrust bars that extends from upstream to downstream of the apparatus, to make the separate groups of articles and to convey the groups downstream; a plurality of devices designed to insert the partitions, placed over the article conveyor and in sequence along the article conveying path, to allow the free fall or to throw downwards the partition elements; channel devices, to obtain the transverse displacement of the longitudinal ranks of the articles; and a further belt conveyor that is coplanar with the transport plane of the articles, which is designed to act in the operative area of the first conveyor and to successively speed up the transverse ranks of the articles so as to get a temporary spacing between the transverse ranks.

The apparatus of patent IT-1.154.364, essentially is comprised of: a multiple belt conveyor to transport the articles ordered in transverse and longitudinal ranks from upstream to downstream; an automatic fixed dispenser, placed upon the flow of the containers that advance longitudinally and designed for throwing transverse partition elements from above downwards; and a spacing device to temporarily space longitudinally the transversal ranks of the articles.

The spacing device essentially includes a plurality of transverse pegs moved along a closed ring path in a vertical orbit by a chain conveyor, in which the upper branch of the orbit includes the transport of the pegs between the containers according to the same longitudinal speed of these latter.

In the operation of this device, first the pegs insert between the containers from the bottom upwards and then, during the phase of driving back downwards the chains, they determine the spacing of the container transverse ranks. This is due to the fact that the upper ends of the same pegs, during this phase, define a greater path with respect to the one made by their base, that lies about on the same plane with the article bottoms.

A first drawback is that the longitudinal and transversal elements are inserted from above downward, by moving them down along vertical planes that are perpendicular to the flow of the articles, so as to require a perfect phase relationship between the lowering partition and the advancing articles, and needing a much reduced advancing speed of the articles to have sufficient time to perform the insertion, leading to a lower productivity.

A further drawback, related to the first, is misplacement of the partitions and apparatus jams due to the fact that, to increase the productivity of the apparatus, the partitions are thrown downwardly at a high speed so that they bounce on the transport plane of the articles.

The last drawback lies in the fact that the different stores of the partitions are positioned at a height hardly reachable by the operator, so as these apparatuses must have a supplementary frame that allows the operator to reach those stores. This creates a high risk of possible accidents.

U.S. Pat. No. 4.793.117 discloses a packaging machine for inserting longitudinal partition elements from beneath groups of articles, and longitudinal partition elements from above the articles, which is similar to the one described in Italian Patent No. IT 1.154.364.

From AU-439.944 there is known a method for inserting transverse and longitudinal partition elements, respectively between rows and columns of a batch of closely spaced jars or the like, at two or more operating stations which are subsequently placed on a conveyor platform.

The transverse elements are inserted at a first inserting station, from beneath the platform, through transverse slots suitably made in the platform and after the rows of jars have been accurately placed between the slots.

Jars are then moved to a second station for inserting of longitudinal elements, which are also inserted from beneath the platform, through corresponding longitudinal slots, after the columns of jars have been accurately placed between the slots.

The apparatus carrying out the aforesaid method, although allowing the partition elements to be inserted from beneath the operating platform upwards, has a first serious drawback because it operates intermittently. The partition elements are inserted between rows and columns of each batch of jars only after they have been placed on the corresponding inserting station, and after they have stopped moving. Moreover, each batch must complete the inserting of both the transverse and longitudinal partition elements, before subsequent batch of jars can be moved ot the first inserting station. Thus, the apparatus operating speed and productivity are greatly reduced.

Furthermore, positioning of jars on the stations for inserting of partition elements is extremely critical, because the rows and/or columns of jars must be accurately placed between the slots, in order to allow the partition elements to be inserted between the rows and/or columns. This requires the apparatus to be modified when jars having even a slight different size have to be processed.

A further drawback of the aforesaid apparatus is that a possible damage can occur to the jar labels while inserting the partition elements, because the jars are close together during this operation.

Another drawback arises because it is necessary to provide as many transverse slots as transverse partition elements to be inserted for each batch of jars. For each partition element, a separate magazine is also required. This entails additional work by the operator which has to load the apparatus magazines.

Finally, the maximum numbers of rows allowable for each batch of jars is limited by the number of transverse slots in the first operating station.

DISCLOSURE OF THE INVENTION

The main object of the present invention is therefore to avoid the drawbacks reported above.

The invention includes a method for inserting partition elements between transverse ranks and longitudinal ranks of groups of articles transported along a path, wherein the articles are continuously moved along the transverse ranks and longitudinal ranks are spaced apart during the insertion, and at least one of the partition elements is inserted from the bottom upwards between the transverse ranks and between the longitudinal ranks. After insertion of the partitions the ranks are compacted.

The transverse partition elements can be inserted between the transversal ranks of articles by moving them from the bottom upwards and upstream to downstream with a longitudinal feeding which is concordant to the longitudinal feeding of the transverse ranks.

The longitudinal partition elements can be inserted between the longitudinal ranks by moving the longitudinal partition elements, held in a vertical position, from the bottom upwards and upstream to downstream, with a longitudinal feeding which is concordant to the longitudinal feed of the longitudinal ranks of articles.

The longitudinal feeding speed of the longitudinal partition elements during the phase of insertion between the longitudinal ranks of articles can be substantially equal to the feeding speed of the ranks of articles moving along the operating path.

An apparatus for inserting partition elements between transverse ranks and longitudinal ranks of groups of articles moved along a path, wherein the transverse ranks and longitudinal ranks are spaced to allow the insertion, can comprise:

at least a device for inserting of transverse partition elements, located in a position underlying the article transport plane, while the articles are continuously moved on the operating path, and at least an opening, located along the operating path, which is able to allow the partition elements to pass a zone underlying the path to a zone overhanging the path, wherein the partition elements are moved from the bottom upwards through the opening between the transverse ranks of articles;

and at least a device for inserting of longitudinal partition elements, located in a position underlying the article transport plane, while the articles are continuously moved on the operating path, and at least an opening, located along the operating path, which is able to allow the partition elements to pass from a zone underlying the path to a zone overhanging the path, wherein the partition elements are moved from the bottom upwards through the opening between the longitudinal ranks.

The devices for insertion of transverse partition elements can comprise:

at least a store, longitudinally extending, to store the transversal partition elements;

at least an extracting-transferring device, able to extract and to transfer the transversal partition elements in succession from the store;

a conveyor able to transport the transversal partition elements carried by the collecting-transferring device upwards between the articles by passing them through the insertion opening.

The conveyor can comprise a pair of belts or chains provided with slugs wrapping around a closed path in respective parallel planes on respective wheels, wherein the upper wheels are positioned between rollers of a drive-back roller group of a conveyor.

The apparatus can have at least an opening for inserting the longitudinal partition elements, the opening being obtained by means of a sliding surface formed with transversely spaced shims, which are provided with guides.

The following results are obtained by the use of a method and of an apparatus of this type:

the partition elements are more easily inserted;

the rebound of these elements on the transport plane of the articles is avoided;

the stores for the partition elements are easily reached by the operator.

The advantages obtained with the present invention, essentially, are that it is possible to move the articles more quickly than improving the productivity of the apparatus, that it is possible to avoid the problems due to the rebound of the partition elements and to have no supplementary frame to allow the operator access to the stores of the partition elements, thereby reducing the risks of possible accidents because of the easy access to the frame.

BRIEF DESCRIPTION OF THE DRAWING

Further characteristics and advantages of the present invention will be better pointed out in the following detailed description of the preferred embodiment, with reference to the accompanying drawing, in which:

FIGS. 4, 4A and 4B are schematic top views in the region along the line IV—IV of FIG. 1A of three successive sequences; and FIG. 5 is a sectional view along the line V—V of FIG. 1A.

BEST MODE OF CARRYING OUT THE INVENTION

Figure 1:
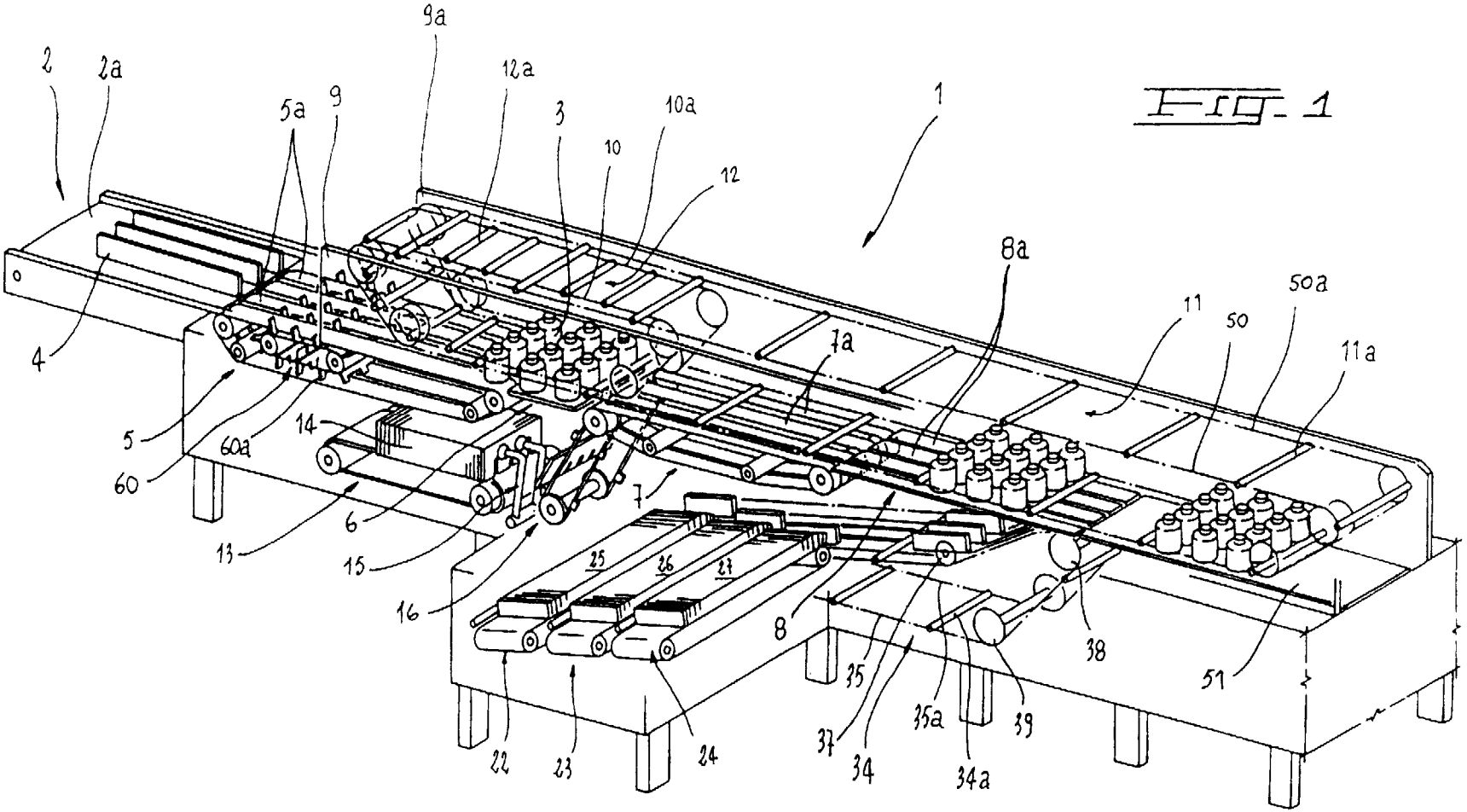
FIG. 1 is a perspective view of the apparatus of the present invention.

The drawing shows an apparatus designed to package groups of articles 100, 200, 300, 400, 500 and 600 comprising three transverse ranks and four longitudinal ranks of articles 3. It is clear that the method and the apparatus here disclosed could be used also with different groups sizes. The longitudinal ranks extend in the direction of advance of the groups of articles along the path and the transverse ranks are perpendicular to this direction.

Figure 1A:
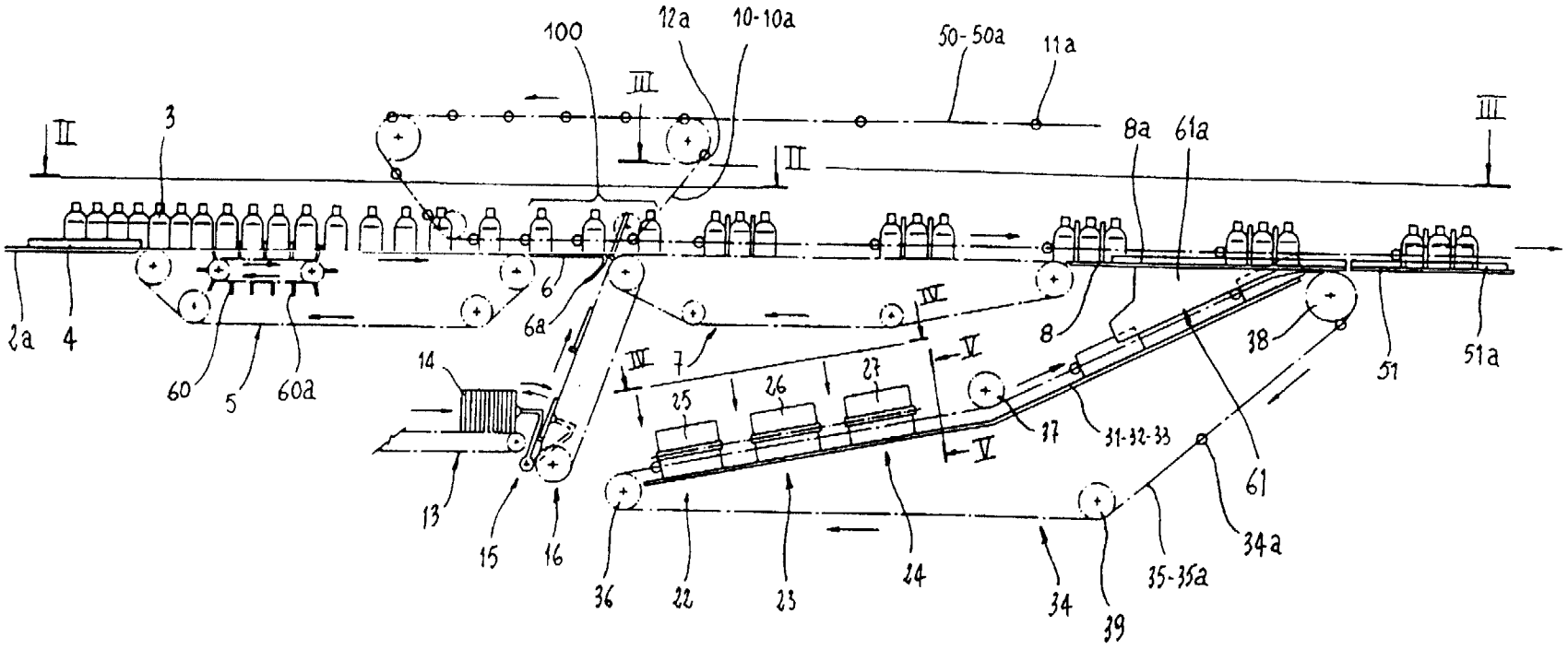
FIG. 1A is a schematic side view of the apparatus of FIG. 1.

With reference to the FIGS. 1 and 1A the apparatus 1 of the present invention has an upstream end 2 linked with a feeding machine, not shown, that feeds a continuous flow of the articles 3 to be packed, that can be bottles.

Figure 3:
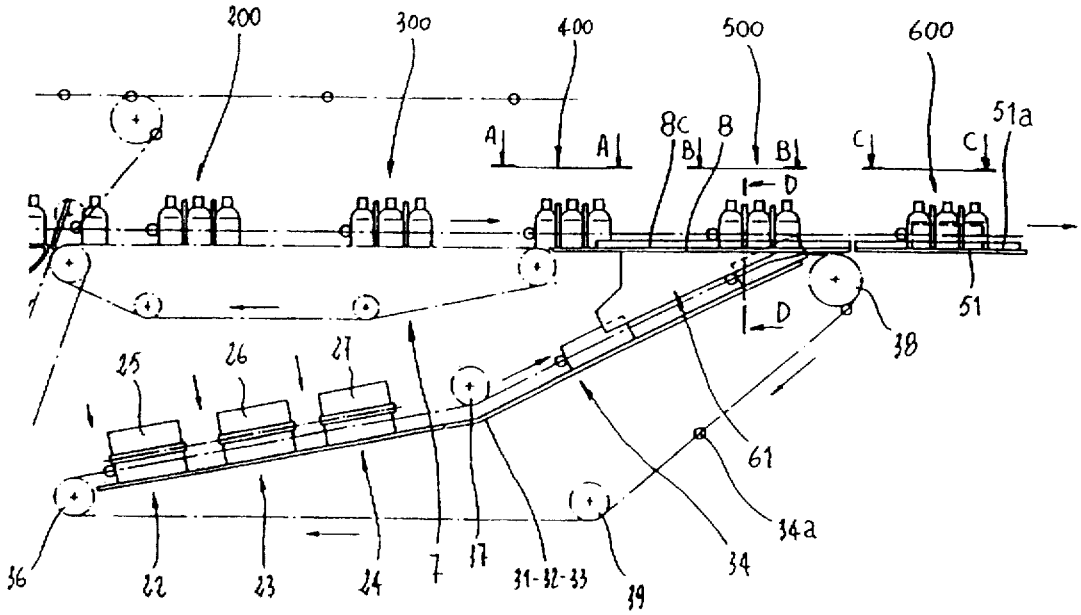
FIG. 3 is a schematic side view of the region along the line III—III of FIG. 1A.
Figure 3A:
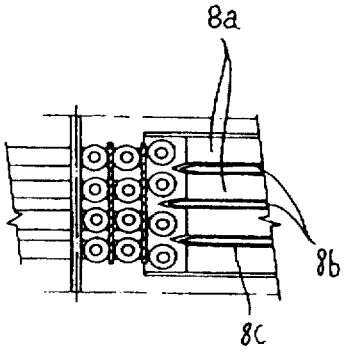
FIGS. 3A, 3B and 3C are three schematic cop views respectively at the regions of the lines A, B and C of FIG. 3.
Figure 3B:
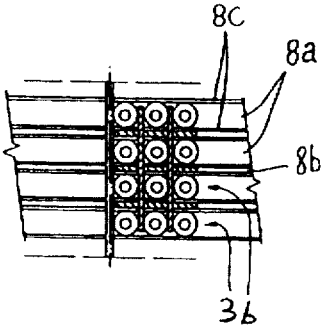
Figure 3C:
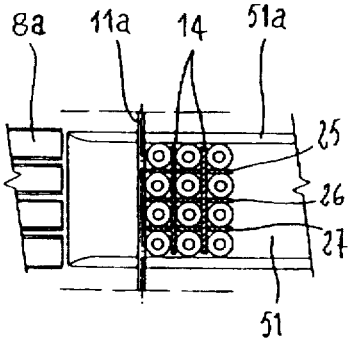

The horizontal transport plane of the articles 3, from upstream to downstream, is in succession constituted by: a first sliding surface 2*a* provided with a plurality of known channel guides 4; a first conveyer 5 provided with multiple endless belts 5*a*; a second sliding plane 6; a conveyer 7 with multiple endless belts 7*a*; a third sliding plane 8 comprising, see FIGS. 3A, 3B and 3C, a plurality of longitudinally extending shims 8*a* and provided with guides 8*c*, and that are mutually transversely spaced to determine the openings 8*b* extending longitudinally; and, at least, a sliding continuous plane 51 having convergent guides 51*a*, see the FIG. 3C.

The upper portion of the apparatus 1, as regards the article transport plane, comprises a pair of side vertical shoulders 9, 9*a*, extending longitudinally, that support an endless conveyor 11, which includes a pair of chains 50, 50*a*, each of which are wrapped on respective chain wheels and supports one end of respective plurality of transversal thrust bars 11*a*, so defining a closed annular path, the lower branch of which provides the transport of the articles 3 from upstream to downstream of the apparatus 1.

An endless conveyor 12 is placed inside the conveyor 11, is similar to this latter and includes a pair of chains 10, 10*a*, each of which are spooled on respective chain wheels and support one end of respective plurality of transverse thrust bars 12*a* that, along the lower branch of their closed ring path, operate within the operation of the branch of the lower operative path of the bars 11*a*, as described and shown in another Italian Patent Application No. BO94A 000215 filed in the name of this applicant on the same date and corresponding to U.S. application Ser. No. 08/581,564 of 16 Jan. 1996 now U.S. Pat. No. 5,667,055.

The lower portion of the apparatus 1, from upstream to downstream, in sequence includes: a first closed path conveyor 60 which supports transversal ranks of slugs 60*a*, designed to insert between the belts 5*a* of the conveyor 5; the store 13 of a large amount of transverse partition elements 14; extracting-transferring means 15 fit to extract and transport in a single succession partition elements 14 from the store 13; and a close ring conveyor 16 fit to convey in succession one after the other transversal partition elements 14 handled by the extracting-transferring means 15.

Figure 2:
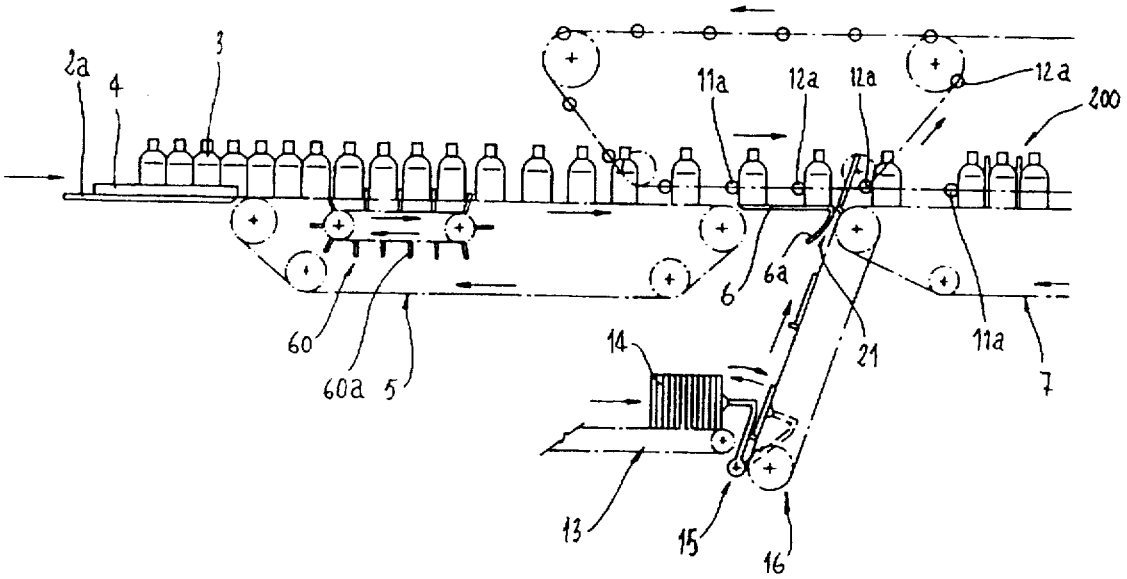
FIGS. 2 and 2A are respectively a schematic side view and a schematic top view, along the line II—II of FIG. 1A.
Figure 2A:
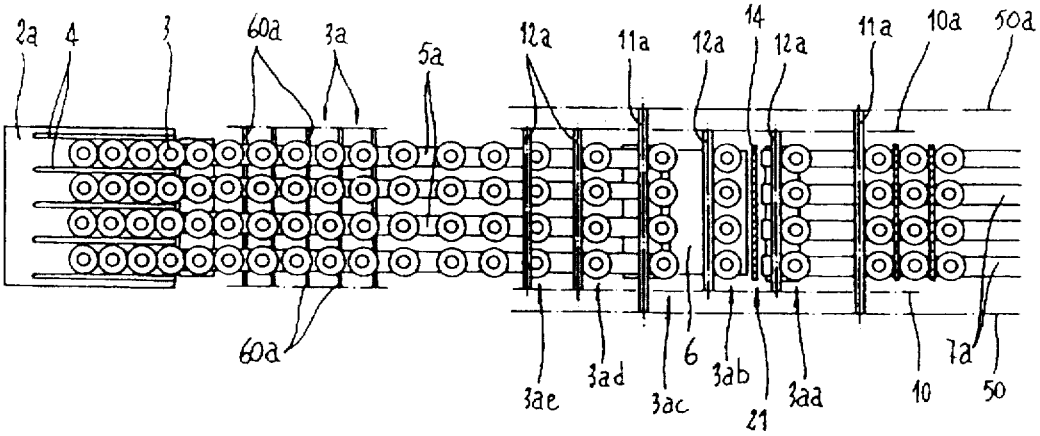
Figure 2B:
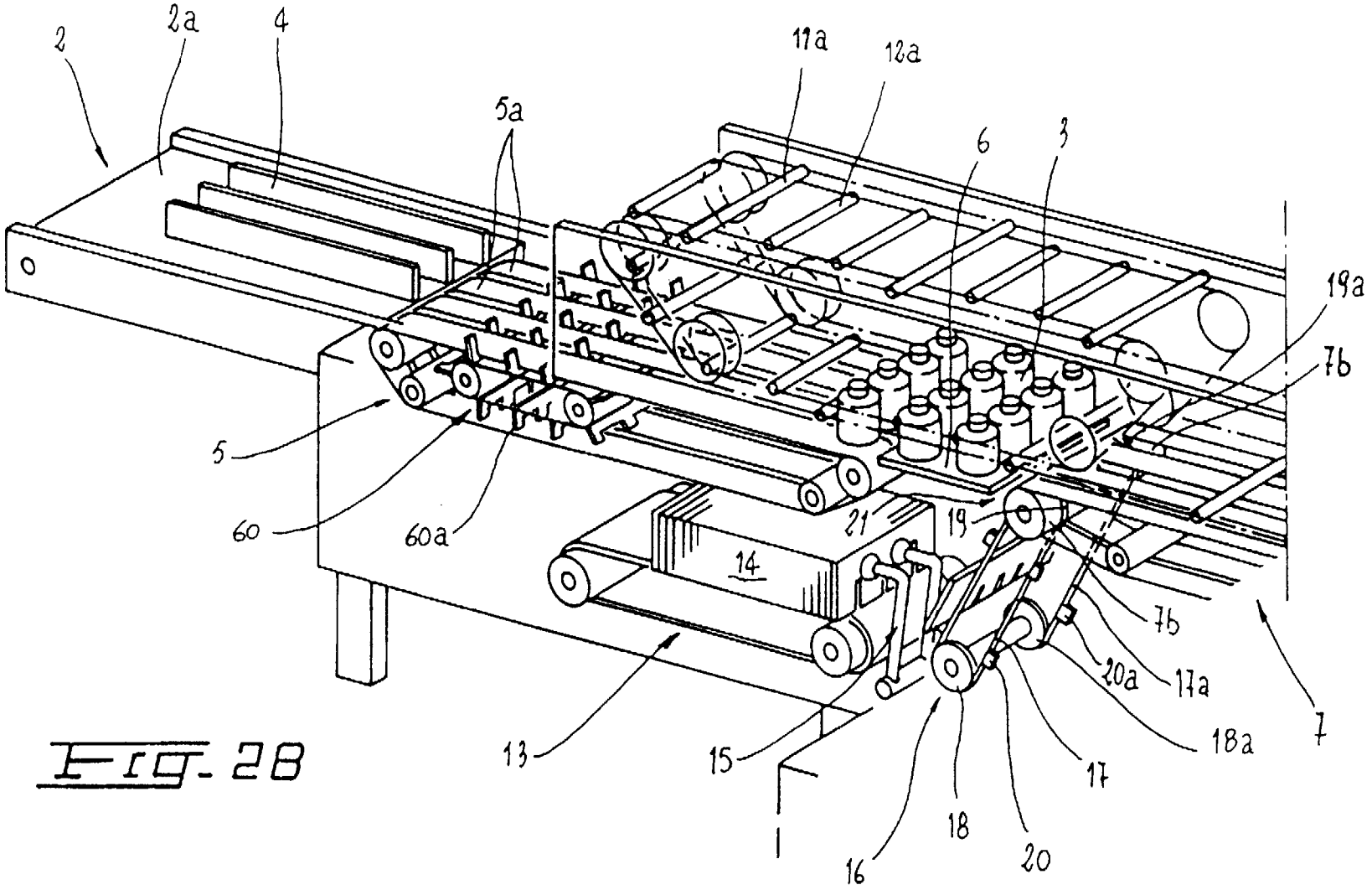
FIG. 2B is an enlarged perspective view of a portion of FIG. 1.

Particularly, see FIG. 2*b* too, the conveyor 16 includes a pair of belts or chains 17, 17*a* wrapped on respective wheels 18–19, 18*a*–19*a*, and which support a plurality of pairs of slugs 20, 20*a*, the upper wheels 19, 19*a* being located between rolls 17*b*, 7*b* belonging to the transmission roll upstream of the conveyor 7.

The conveyor 16 is vertically sloping to define an operative path designed to convey in sloping way from the bottom upwards and upstream to downstream, the partitions 14 upright in series, through an opening 21 between the sliding surface 6 and the conveyor 7. Moreover, a switch element 6*a* (see FIG. 1A), fit to switch inside the opening 21 partition elements eventually not well transported, is provided to avoid wrong insertions of the partition 14 through the opening 21.

With reference also to the FIGS. 4, 4A, 4B, and 5, in the lower portion of the apparatus 1, and downstream with respect of the above mentioned conveyor 16, three stores 22, 23, 24 of known type, are fit to store related longitudinal partition elements 25, 26, 27 and three extracting-transferring devices 28, 29, 30 are fit to take and to transport respective longitudinal partitions 25, 26, 27, respectively comprising one or more swinging arms 28*a*, 29*a*, 30*a*, supporting respective suction means 28*b*, 29*b*, 30*b*.

Below the extracting-transferring devices 28, 29, 30, there are three respective guides 31, 32, 33 longitudinally extending, from upstream to downstream, from the bottom upwards, from a zone close to the extracting-transferring devices 28, 29, 30 till next to a zone downstream of the plane 8 and directly below this latter, see also FIGS. 1 and 1A.

With reference to FIG. 5, the guides 31, 32, 33 have a first portion with transverse section like an inverted "L" designed to support relative longitudinal partition elements 25, 26, 27 which are moved by the relative extracting-transferring devices 28, 29, 30. The second middle portion of the guides has a transverse section "U" shaped designed to support the same partition elements 25, 26 and 27 in vertical-longitudinal position.

Figure 3D:
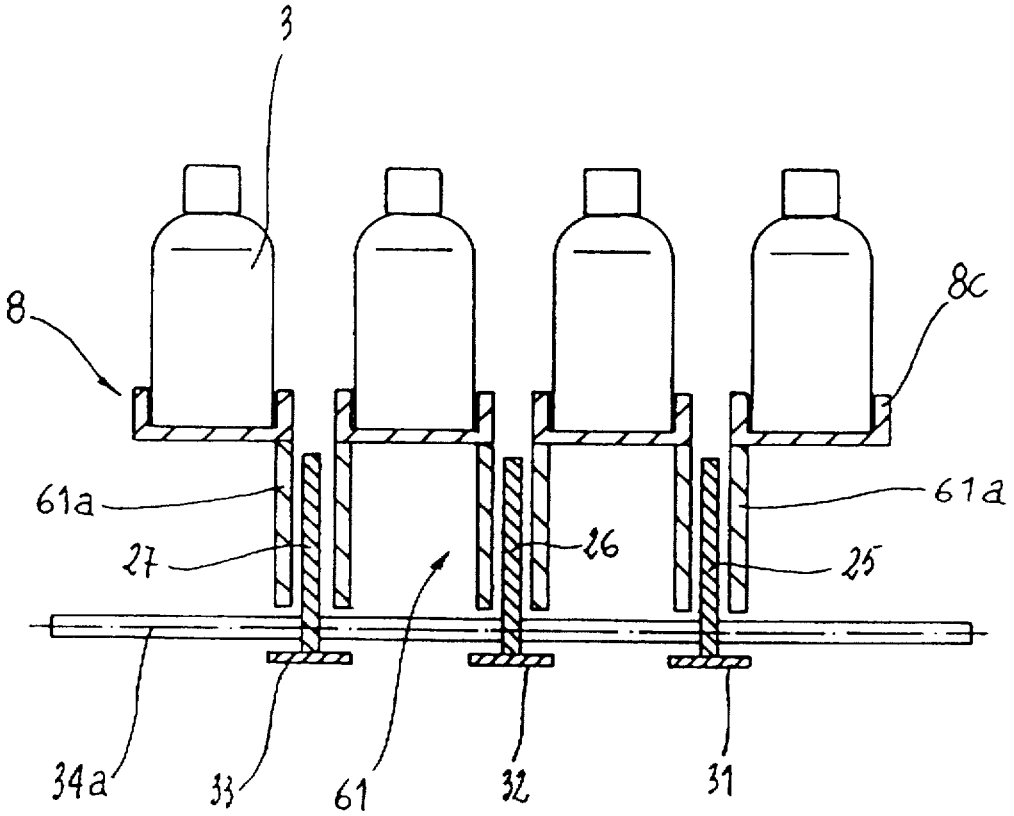
FIG. 3D is a schematic sectional view along the line D—D of FIG. 3.

With reference to FIGS. 1A and 3D, the third end portion of the guides 31, 32, 33 has a rectangular transverse section and it is fit to support the bottom of the partitions 25, 26, 27 and to cooperate with a guide-group 61 that has a series of longitudinal guides 61*a*, protruding from the lower plane of the sliding surface 8 downwards. The lower rim of the guide-group 61 is vertically spaced from the upper surface of the rectangular section in order to allow the passage of thrust bars 34*a*, better described later, without any interference.

An endless conveyor 34 includes a pair of chains 35, 35*a*, wrapped onto relative chain wheels 36, 37, 38, 39, 36*a*, 37*a*, 38*a*, 39*a* (not all of them are shown in the Figures), and the chains support a plurality of thrust bars 34*a* that move along a closed path, the upper branch of which is parallel to the upper level of the guides 31, 32, 33.

It must be noted that the operative path of the bars 34*a* is located in correspondence of a level slightly above the guides 31, 32, 33, but so as to not interfere with the operation of the suction means 28*b*, 29*b*, 30*b*, as shown in FIG. 5. With reference to the third end portion of the guides 31, 32, 22, the above mentioned operative path does not interfere with the lower end of the guide-group 61.

The apparatus 1 is also equipped with known mechanical and/or electrical and/or electronic and/or computerized devices fit to synchronize the apparatus.

The operation of the apparatus 1 includes the incoming of a continuous flow of articles 3 from a feeding machine linked with the upstream end 2 of the apparatus 1.

The continuous flow of articles 3 in the longitudinal path moves onto the sliding surface 2*a* so that the articles 3 are pushed inside the longitudinal channels defined by the guides 4 obtaining their longitudinal alignment (see FIGS. 2 and 2A).

Downstream of the sliding surface 2, the articles 3 are transported by the conveyor 5 downstream and towards the longitudinal ranks of pegs 60*a* protruding from the bottom between the belts 5*a* in order to transversely align the article 3 to define transverse ranks 3*a*.

The transverse ranks of pegs 60*a* insert between the transversal ranks 3*a* of articles 3, and because of the longitudinal speed of the transverse ranks of pegs 60*a* is lower than the speed of the conveyor 5, see FIGS. 1A, 2, 2A, the pegs 60*a* touch the frontal portion of the articles 3, giving these latter a translation speed downstream equal to the speed of the pegs 60*a*, that is lower than the speed of the conveyor 5.

The transverse ranks are moved onto the conveyor 5 and when a transversal rank of pegs 60*a* is diverted downwards next the downstream end of the conveyor 60, the transversal rank 3*a*, which was blocked by the rank of pegs 60*a*, is free to move with the greater longitudinal speed of the conveyor 5. Since the subsequent transversal rank of articles 3 is still blocked by its pegs 60*a*, a first longitudinal spacing between the downstream transverse rank of articles 3 and the next upstream transverse rank 3*a* of articles 3 that is till blocked by the subsequent rank of pegs 60*a*.

The transverse ranks 3*a* of the articles 3 are spaced and are conveyed downstream by means of the conveyor 5. The thrust bars 11*a* and 12*a* lower from above downwards, insert between the transversal ranks 3*a*, and advance the transverse ranks 3*a* and set them in a correct phase relationship for the subsequent operations, as shown in FIG. 2A with the numeral references 3*aa*, 3*ab*, 3*ac*, 3*ad*, 3*ae* and so one. If necessary, the thrust bars 11*a* and 12*a* increase the longitudinal spacing therebetween.

It should be noted that, for reasons better clear in the following description, the group of article 100 has the two transversal front ranks 3*aa*, 3*ab*, pushed by two bars 12*a* of the conveyor 12, while the transversal rear rank 3*ac* is pushed by a bar 11*a* of the conveyor 11.

The article transversal ranks 3*a* are so moved upon the sliding surface 6 and, in phase relationship with the advancement thereof, a partition element 14 is inserted between the two front transversal ranks 3*aa* and 3*ab* of the group 100 of article 3. This partition element passes, from the bottom upwards, through the opening 21 between the sliding surface 6 and the conveyor 7.

The partition element 14 is inserted along a sloping plane having a direction from the bottom upwards and upstream to downstream, by means of the conveyor 16, which, with the slugs 20, 20*a*, takes and transfers the elements 14, extracted from the store 13 and transferred by the extracting-transferring device 15.

In this manner a first partition element 14 will be inserted between the first and second transverse rank, respectively 3*aa* and 3*ab* and, subsequently, a second partition element 14 will be so inserted between the second and third transverse ranks 3*ab*, 3*ac*. In this specific embodiment, no partition elements will be inserted between the rank 3*ac* and the rank 3*ad*, thus obtaining a group 200 of articles 3 provided with two transverse partition elements 14.

With reference to FIGS. 2 and 2A, each transverse rank 3*aa*, 3*ab*, 3*ac* is pushed by respective thrust bars 12*a*, 12*a*, 11*a*, downstream onto the conveyor 7; subsequently bars 12*a*, 12*a* pass upwards so that only the bar 11*a* longitudinally pushes the group 200.

The speed of the conveyor 7 is less than that of the bars 11*a*, so during the transport of the group of articles on the conveyor 7 a longitudinal compaction between the transverse ranks 3*a* of articles, which were previously spaced, is obtained.

Referring to FIGS. 3, 3A, 3B and 3C, groups 200, 300 of articles 3 are routed by bars 12*a* and by conveyor 7 on the sliding surface 8 and against the diverging heads of guides 8*c* (see FIG. 3A), thus separating the group 400 to longitudinal ranks 3*b*, between which the openings 8*b* extend.

Referring now to FIG. 5, the extracting-transferring devices 28, 29, 30 withdraw respective partition elements 25, 26, 27, bringing them to the respective guides 31, 32, 33, which have an inverted "L" shape, for a further transport.

Referring to FIGS. 4, 4A, 4B and 5, the thrust bars 34*a* of conveyor 34, driven in a phase relationship with the operating cycle of the apparatus 1, during their upper active path, engage the rear edge of the longitudinal partition element 25 first, then, in a succession, the rear edges of the longitudinal partition elements 26 and 27 (FIGS. 4A and 4B) to push three partition elements 25, 26, 27 transversely aligned within respective longitudinal guides 31, 32, 33. Those, as mentioned above, have a transversal shape of a "U" for an intermediate stretch of their longitudinal extension, while their final downstream stretch forms a rectangle-shaped guide (FIG. 3D) exclusively able to hold the partition elements and a plurality of vertical guides 61*a*, which extend longitudinally and downwards the sliding surface 8; the vertical guides 61*a* are designed to hold in a vertical and longitudinal position the partition elements.

The partition elements are so routed from the bottom upwards and upstream to downstream under the sliding surface 8, having a longitudinal and vertical position and transversely centered with respect to the openings 8*b* located between the shims 8*a*. Afterwards, near the downstream end of the sliding surface 8, they are inserted between the longitudinal ranks 3*b* of articles 3, passing through the openings 8*b*.

After the insertion, just after the downstream end of the conveyor 34, the group 500, provided with transverse partition elements 14, 14 and with longitudinal partition elements 25, 26, 27, is transferred from the sliding surface 8 to the sliding surface 51 which transversely accumulates the group 500, as shown at 600. The group 600 then continues its transferring to further packaging operation.

I claim:

1. A method of inserting partitions between articles during continuous advance thereof, comprising the steps of:

(a) providing a transport path extending in a longitudinal direction;

(b) assembling a group of articles in at least two transverse ranks extending transversely to said longitudinal direction;

(c) continuously advancing said group of articles in said direction downstream along said path while spacing a relatively upstream one of said ranks from a relatively downstream one of said ranks;

(d) while continuing to advance said group of articles, passing said downstream one of said ranks over a transverse opening;

(e) feeding a flat transverse partition element between said ranks by passing an upper edge of said partition element upwardly through said opening while continuing to advance said group of articles and after said downstream one of said ranks has passed over said transverse openings, and passing a lower edge of said partition element upwardly through said opening before said upstream one of said ranks arrives at said opening; and (f) while continuing to advance said group of articles, closing the spacing between said ranks.

2. The method defined in claim 1 wherein said transverse partition element is fed in step (e) in a plane sloping from its bottom upwardly in an upstream to downstream direction of said path.

3. An apparatus for inserting partitions between articles during continuous advance thereof, said apparatus comprising:

means providing a transport path extending in a longitudinal direction;

means for assembling a group of articles in at least two transverse ranks extending transversely to said longitudinal direction;

continuously operating conveying means with thrust bars for continuously advancing said group of articles in said direction downstream along said path while spacing a relatively upstream one of said ranks from a relatively downstream one of said ranks;

means along said path forming a transverse opening over which said articles can be moved by said continuously operating conveying means; and inserting means below said path and in phase with said conveying means for feeding a flat transverse partition element between said ranks by passing an upper edge of said partition element upwardly through said opening while continuing to advance said group of articles and after said downstream one of said ranks has passed over said transverse openings, and passing a lower edge of said partition element upwardly through said opening before said upstream one of said ranks arrives at said opening, said conveying means including means for continuing to advance said group of articles while closing the spacing between said ranks.

4. The apparatus defined in claim 3 wherein said conveying means includes a downstream conveyor defining said path downstream of said opening and said inserting means includes another endless conveyor having wheels located at an upstream end of said downstream conveyor and carrying pegs for entraining said partition element through said opening.

5. The apparatus defined in claim 4 wherein said other endless conveyor slopes upwardly from upstream to downstream in said direction.

6. The apparatus defined in claim 3 wherein said conveying means includes a first upstream conveyor having thrust bars for engaging pluralities of transverse ranks of articles for advancing same along said path, and a second upstream conveyor having thrust bars for engaging individual transverse ranks of said articles, the thrust bars of said second conveyor withdrawing from engagement with said ranks for closing of the spacing between ranks.

7. The apparatus defined in claim 3, further comprising a switching element disposed adjacent said opening and below said path for guiding said partition element into said opening.

8. A method of inserting partitions between articles during continuous advance thereof, comprising the steps of:

(a) providing a transport path extending in a longitudinal direction;

(b) assembling a group of articles in a plurality of longitudinally extending ranks extending in said direction;

(c) continuously advancing said group of articles in said direction downstream along said path while transversely spacing said ranks apart so that said ranks flank opposite sides of respective longitudinal openings formed along said path;

(d) while continuing to advance said group of articles, feeding a respective upright flat longitudinally extending partition element between said ranks by continuously passing said partition elements upwardly through said openings synchronously with the continuous advance of the group of articles from below in an upstream to downstream direction; and (e) while continuing to advance said group of articles, closing the spacing between said ranks.

9. An apparatus for inserting partitions between articles during continuous advance thereof, said apparatus comprising:

means for forming a transport path extending in a longitudinal direction;

means at an upstream location along said path for assembling a group of articles in a plurality of longitudinally extending ranks extending in said direction;

conveying means for continuously advancing said group of articles in said direction downstream along said path;

guide means along said path for transversely spacing said ranks apart as said group of articles is continuously advanced along said path so that said ranks flank opposite sides of respective longitudinal openings formed along said path; and inserting means synchronized with said conveying means for feeding a respective upright flat longitudinally extending upright partition element between said ranks by continuously passing said partition elements upwardly through said openings synchronously with the continuous advance of the group of articles from below in an upstream to downstream direction; and means downstream of said openings for closing said spacing while continuing to advance said group of articles.

10. The apparatus defined in claim 9 wherein said guide means include respective sliding channels for said ranks with longitudinally extending shims flanking said openings.

11. The apparatus defined in claim 9 wherein said means downstream of said openings are convergent guides.

12. The apparatus defined in claim 9 wherein said inserting means include:

respective upwardly inclined guides for said partition elements;

means for positioning a respective one of said partition elements on each of said guides; and a conveyor having a thrust bar engageable behind the partition elements positioned on said guides for feeding said partition elements upwardly through said openings.

13. The apparatus defined in claim 12, further comprising further guide elements projecting downwardly adjacent said openings for guiding upper parts of said partition elements into said openings.

* * * * *